US007164400B2

(12) United States Patent
Mizukoshi et al.

(10) Patent No.: US 7,164,400 B2
(45) Date of Patent: Jan. 16, 2007

(54) SETTING BLACK LEVELS IN ORGANIC EL DISPLAY DEVICES

(75) Inventors: Seiichi Mizukoshi, Kanagawa (JP); Nobuyuki Mori, Saitama (JP); Kouichi Onomura, Kanagawa (JP); Makoto Kohno, Kanagawa (JP)

(73) Assignee: Eastman Kodak Company, Rochester, NY (US)

( * ) Notice: Subject to any disclaimer, the term of this patent is extended or adjusted under 35 U.S.C. 154(b) by 499 days.

(21) Appl. No.: 10/767,288

(22) Filed: Jan. 28, 2004

(65) Prior Publication Data

US 2005/0052350 A1 Mar. 10, 2005

(30) Foreign Application Priority Data

Mar. 6, 2003 (JP) ..... 2003-060541

(51) Int. Cl.
*G09G 3/30* (2006.01)

(52) U.S. Cl. ..... 345/76; 345/77; 315/169.3

(58) Field of Classification Search ..... 345/55–56, 345/76–78, 82–84, 90, 214; 315/169.1, 169.3
See application file for complete search history.

(56) References Cited

U.S. PATENT DOCUMENTS 6,667,580 B1 * 12/2003 Kim et al. ..... 315/169.3
6,690,117 B1 * 2/2004 Komiya ..... 315/169.3
2005/0083268 A1 * 4/2005 Mori et al. ..... 345/76

FOREIGN PATENT DOCUMENTS

JP 2002-251167 9/2002

* cited by examiner

*Primary Examiner*—Richard Hjerpe
*Assistant Examiner*—Mansour M. Said
(74) *Attorney, Agent, or Firm*—Raymond L. Owens

(57) ABSTRACT

To appropriately adjust luminance and a black level even when characteristics of an organic EL display element should be changed due to an environmental change or heat self-generation, to display a stable image. A current detector detects a level of a total panel current flowing in an organic EL panel. The detected level is subjected to A/D conversion before being supplied to an adder. Meanwhile, a video signal is supplied to a current calculator 24 to be converted into data corresponding to the level of a total panel current, before being supplied to the adder. The adder then compares an average total panel current level, estimated based on a video signal, and an actual total panel current level, to obtain a difference so that a black level for image data to be supplied to the panel is adjusted according to the difference.

3 Claims, 6 Drawing Sheets

SETTING BLACK LEVELS IN ORGANIC EL DISPLAY DEVICES

FIELD OF THE INVENTION

The present invention relates to setting of a black level in an organic electroluminescent (EL) device.

BACKGROUND OF THE INVENTION

FIG. 1 shows an example of a circuit structure for one pixel of an active-type organic EL display device (a pixel circuit). In this structure, a driving thin film transistor (TFT 1) of a P-channel type is connected, via its drain, to an anode of an organic EL element 3, via its source, to a power source line PVdd, and, via its gate, to a source of a selecting thin film transistor (TFT 2) of an N-channel type. The organic EL element 3 is further connected, via its cathode, to a cathode power source CV. The selected TFT 2 is further connected, via its drain, to a data line Data and, via its gate, to a gate line Gate. The gate of the driving TFT 1 is also connected to one end of a holding capacitor C, which is further connected, on its other end, to a capacitor power source line Vsc.

The gate line, which runs in the horizontal direction, is made an H level to thereby turn on the selected TFT 2. With the selected TFT 2 remaining in an ON state, a data signal having a voltage corresponding to a display luminance value is applied to the data line Data, which runs in a vertical direction, so that the data signal is held in the holding capacitor C. Then, the driving TFT 1 supplies a driving current according to the data signal to the organic EL element 3, which is thereby caused to emit light. The amount of light emission is substantially proportional to that of the driving current.

Here, in general, such a voltage Vth that causes a drain current to begin flowing at around a black level of an image is applied to between the gate of the driving TFT 1 and the power source line PVdd, and an image signal is given such an amplitude that can realize a predetermined level of luminance at around a white level.

FIG. 2 shows the relationship between a gate-source voltage Vgs of the driving TFT 1 (a voltage difference between the data line Data and a power source Pvdd) and a current icv flowing in the organic EL element 3 (corresponding to luminance). By determining a data signal such that a voltage Vth is given as a black level voltage and a voltage Vw is given as a white level voltage, color tones for the organic EL element 3 can be appropriately controlled.

The voltage Vth, however, is likely to change due to a change in temperature or external light. That is, upon change in an environment in which the panel is used or generation of heat by the panel itself, image luminance may change and flat black or shallow black may be caused. Moreover, an excessive current may flow into the panel, which may accelerate deterioration of an OLED element.

In view of the above, there has been disclosed a method for detecting total panel current to change contrast and/or a luminance level of an input signal based on a detection result in order to limit a current flowing into the display panel (See Japanese Patent Laid-open Publication No. 2002-251167).

This method, however, cannot compensate for a change in a black and/or white level caused due to an environmental change, as it can only limit a current flowing in the display panel. Thus, an appropriate display cannot be maintained should an environmental condition be changed.

SUMMARY OF THE PRESENT INVENTION

It is an object of the present invention to display a stable image through appropriate adjustment of luminance and/or a black level even in the case where characteristics of an organic EL display element are changed due to an environmental change or self-generated heat.

This object is achieved by an organic EL display device having a display panel where a plurality of organic EL elements responsive to the display panel are arranged, comprising:

black level setting means for creating a driving command for each organic EL element, by shifting display data for each pixel relevant to an display-image to be displayed on a display panel, according to a black level voltage setting level;

display data calculating means for calculating a level of estimated current which corresponds to a current which flows in the display panel, based on the display data supplied to the display panel;

panel current detecting means for detecting the panel current flowing through all pixels of the display panel;

comparing means for comparing the value of the estimated current calculated by the display data calculating means and the level of panel current for corresponding display, which is detected by the panel current detecting means, to obtain a difference; and adjusting means for adjusting the black level voltage setting value based on a result of the comparison by the comparing means.

As described above, according to the present invention, the level of an estimated panel current based on display data is compared with the level of an actually flowing panel current so that a black level voltage setting level or value is adjusted based on the comparison result.

In the above organic EL display device, preferably, the display data calculating means may calculate the level of an estimated current based on a current which would flow in the display panel upon ideal image data display, based on a total or average level of the display data, and the adjusting means may adjust the black level based on a difference obtained by the comparing means.

Preferably, the above organic EL display device may further include: environment estimating means for estimating an environment in which the organic EL display device is installed, according to a result of the comparison by the comparing means.

Environment to be estimated may include temperature and incident light. Estimation of such environmental condition makes it possible to apply adequate processing depending on the environmental condition. For example, should temperature increase, a cooling means may be activated and/or display luminance may be reduced. Moreover, should incident light be caused, image luminance may be increased.

DETAILED DESCRIPTION OF THE INVENTION

In the following, preferred embodiments of the present invention will be described with reference to the following drawings.

Figure 3:
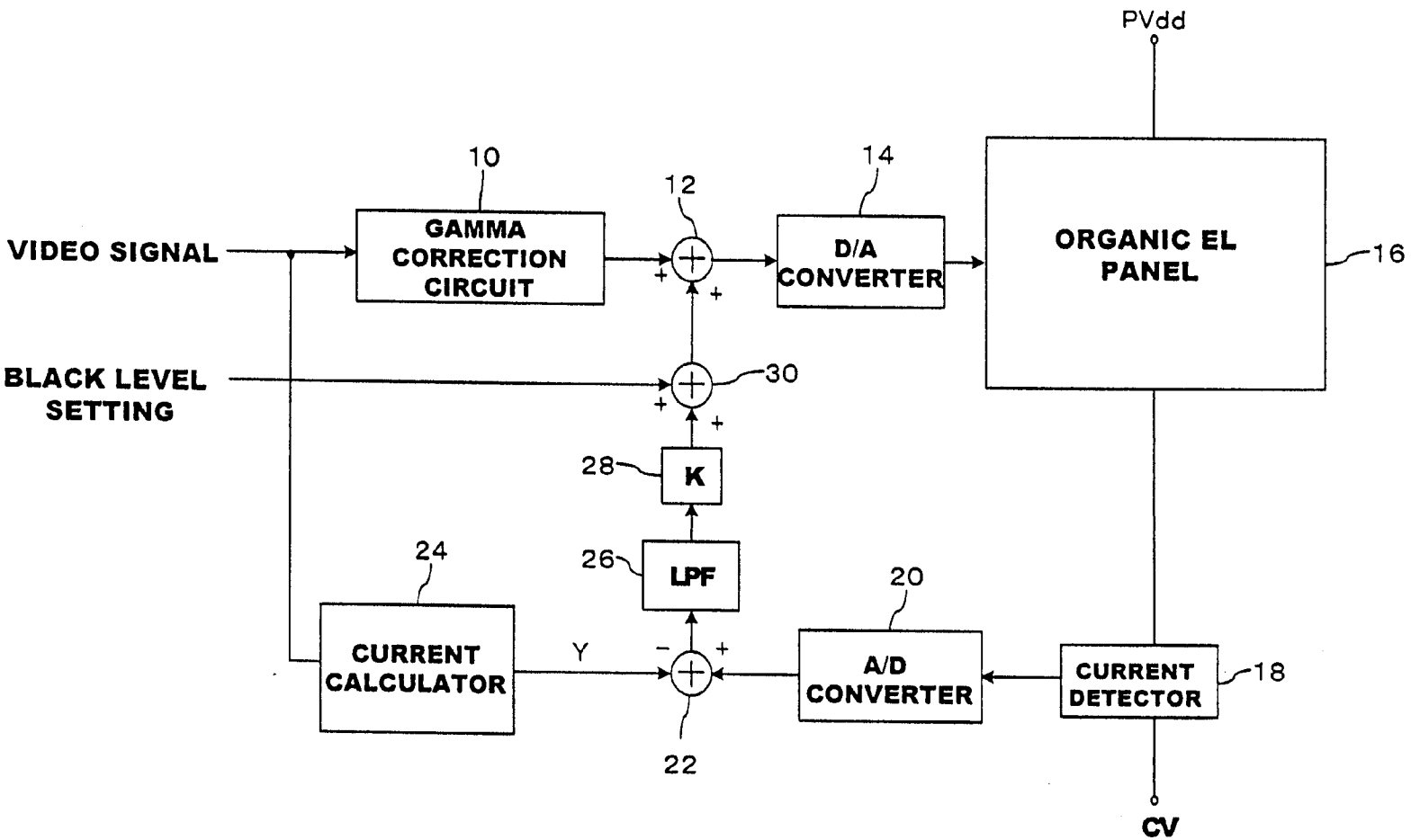
FIG. 3 is a diagram showing a structure of an embodiment of the present invention.

FIG. 3 shows a structure of a device of a preferred embodiment of the present invention. In this device, a video signal including image data for each pixel is input to a gamma correction circuit 10 for correcting a video signal according to predetermined gamma propriety so that the resultant image data has linear relationship with an amount of a current flowing in a pixel. A video signal subjected to gamma correction is supplied to an adder 12 for addition of a black level setting level, so that an output of the adder 12 resultantly constitutes data concerning a driving current for each pixel.

Figure 1:
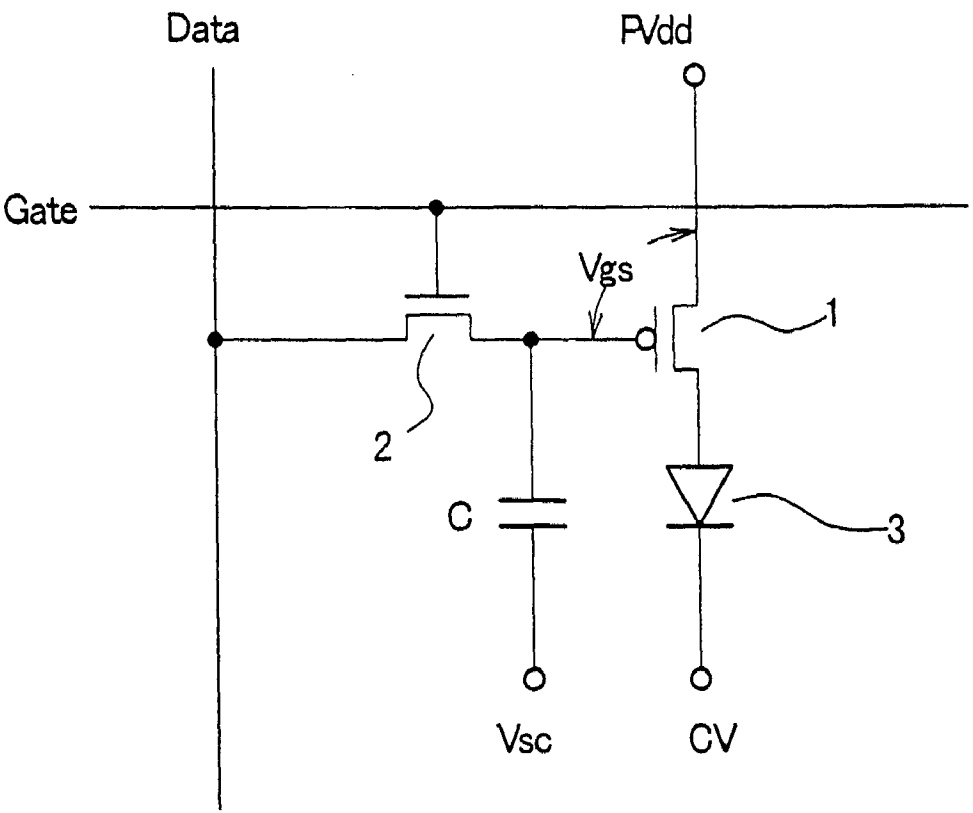
FIG. 1 (PRIOR ART)
FIG. 1 is a diagram showing a structure of a prior art pixel circuit.

The output of the adder 12 is supplied to a D/A converter 14 for conversion into an analog signal, which is supplied to an organic EL panel 16, which includes pixel circuits, as shown in FIG. 1, arranged in a matrix.

Note that a signal from the D/A converter 14 is tentatively stored in a peripheral driving circuit of the organic EL panel 16, and that a driving TFT for each pixel is driven based on each pixel signal stored, whereby a corresponding organic EL element is caused to emit light.

The organic EL panel 16 is also connected to a power source PVdd to receive a driving current for all of the organic EL elements 16 constituting the organic EL panel 16, and further to a current detector 18 which detects the entire current flowing in the organic EL panel 16. That is, a current from the power source PVdd is supplied into each of the organic EL elements according to the received display data, and the total of the current, or a total panel current, is detected by the current detector 18. As each of the pixel circuits of the organic EL panel 16 has holding capacitor and continues light emission for substantially one frame, a total panel current for one frame can be detected by the current detector 18. It should be noted that, as data is written in dot sequence, the detection of a total panel current may preferably be applied during a vertical blinking period subsequent to completion of writing of all data into the organic EL panel 16.

Also note that, instead of a total panel current for one frame, as described above, an accumulated current throughout a few frames may be detected, and an average current may be calculated from the accumulated current. Alternatively, an average or accumulated current for a predetermined period within one frame may be detected.

A detection result by the current detector 18 is converted into digital data in an A/D converter 20 and supplied to an adder 22, which is also supplied with estimated current data for an input video signal as minus data from a current calculator 24. The adder 22 then compares the estimated current data for an input video signal, which corresponds to panel current flowing in the organic EL panel 16, and current level data (a total panel current) corresponding to emission luminance in the organic EL panel 16 and detected by the current detector 18, to obtain a difference.

Here, it should be noted that a level detected by the current detector 18 corresponds to estimated current data for an input video signal for one frame because, where the estimated current data for an input video signal corresponds to a panel current flowing in the organic EL panel 16, a level detected by the current detector 18 concerns a current based on luminance data for each pixel given gamma correction and black level adjustment and supplied to the organic EL panel 16.

Estimated current data for a video signal is obtained by the current calculator 24 as follows. That is, using A=Iyo/yo, for example, the current calculator 24 multiplies average image data for one frame by A to obtain Y to use as an input to the adder 22, that is, estimated current data for a video signal. In the above, Iyo indicates a total current flowing in a pixel section (a total panel current) when displaying an image of an average y0 level (luminance data for all pixels being y0) with adjustment so as to attain the optimum black level and the optimum maximum luminance under normal using condition. That is, Iyo indicates a total panel current subjected to gamma correction and black level adjustment.

Therefore, an output from the current calculator 24 indicates a level of the total panel current subjected to gamma correction and black level adjustment, which flows during a period when image data of a video signal is displayed for one frame on the organic EL panel 16.

Note that, in the case where the current detector 18 detects a current level, such as an accumulated or average current level for a few frames, other than a level of a total panel current for one frame, the level calculated by the current calculator 24 must be compatible with the level.

As described above, a difference between a total current (an estimated current) which should flow through the organic EL panel 16 in view of the luminance of a video signal for one frame in order to achieve appropriate display and a detected total panel current actually flowing through the organic EL panel 16 is obtained by the adder 22. The difference is supplied to a low pass filter (LPF) 26 to be smoothed to thereby remove a large variation so that unstability due to abrupt response can be prevented. The LPF 26 supplies an output to a K multiplier 28 for multiplication by a loop gain K before the resultant output is supplied to an adder 30. Note that a loop gain K determines an extent of adjustment. Specifically, a larger loop gain K can attain a level closer to a setting level (i.e., an initial adjustment level).

The adder 30, which is also supplied with a black level setting level, adds the black level setting level to an output from the K multiplier 28. Here, note that the black level setting level is data in association with the optimum black level achieved under normal using condition, corresponding to a voltage Vth in FIG. 2. That is, data on the optimum black level is adjusted based on the data from the adder 22, as described above, and a result is supplied to the adder 12.

Figure 2:
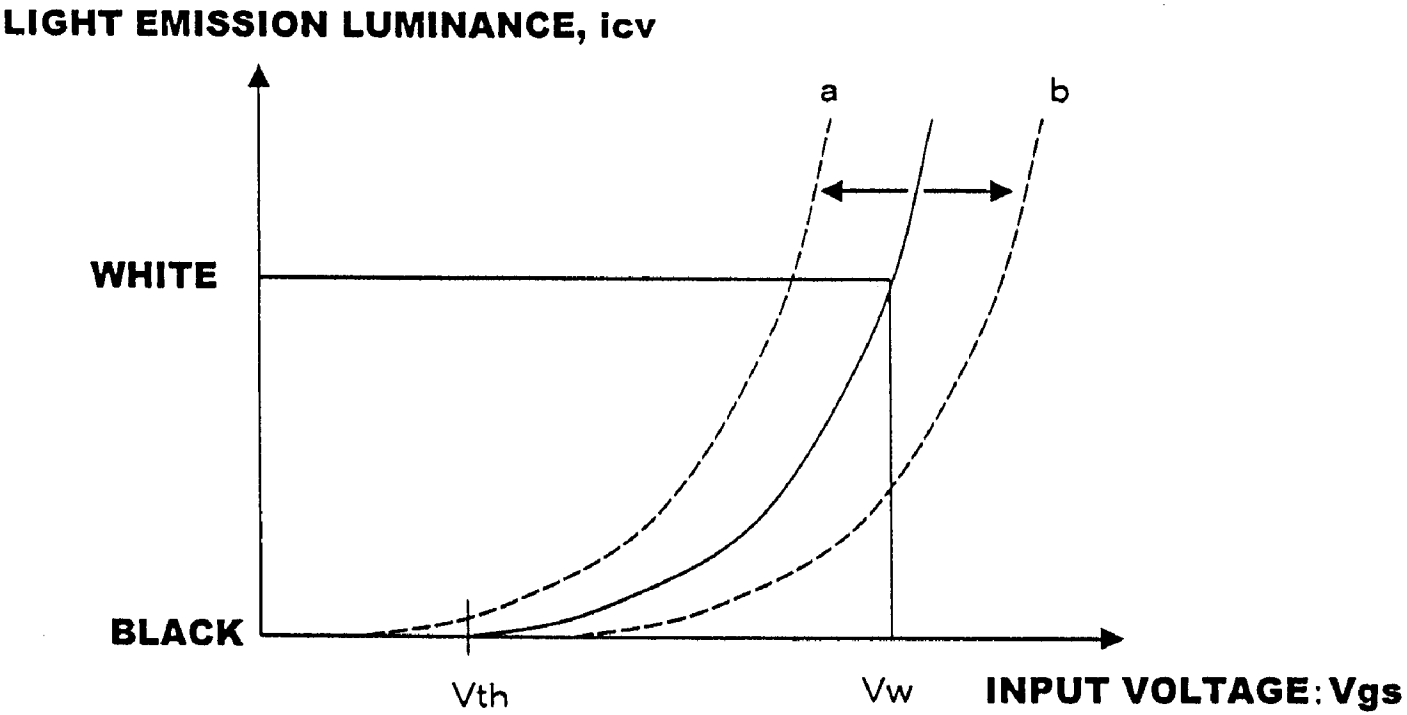
FIG. 2 (PRIOR ART)
FIG. 2 is a diagram depicting a relationship between an input voltage relative to a driving TFT and a light emission luminance.

Therefore, should the relationship between the pixel luminance and the input voltage be changed from the characteristic indicated by the solid line in FIG. 2 to that by the dot line a or b due to a change in an operating or environmental condition, a black level is automatically adjusted accordingly.

That is, when a voltage Vth is changed due to a change in temperature or external light, a total panel current detected by the current detector 18 is changed accordingly, and the amount of the change is extracted as a difference by the adder 22. After being multiplied by a predetermined gain K, the difference is added to display data via the adders 30 and 12. As a result, change in image luminance, as well as flat black or shallow black phenomenon, due to a change of a voltage Vth can be effectively prevented.

Figure 4:
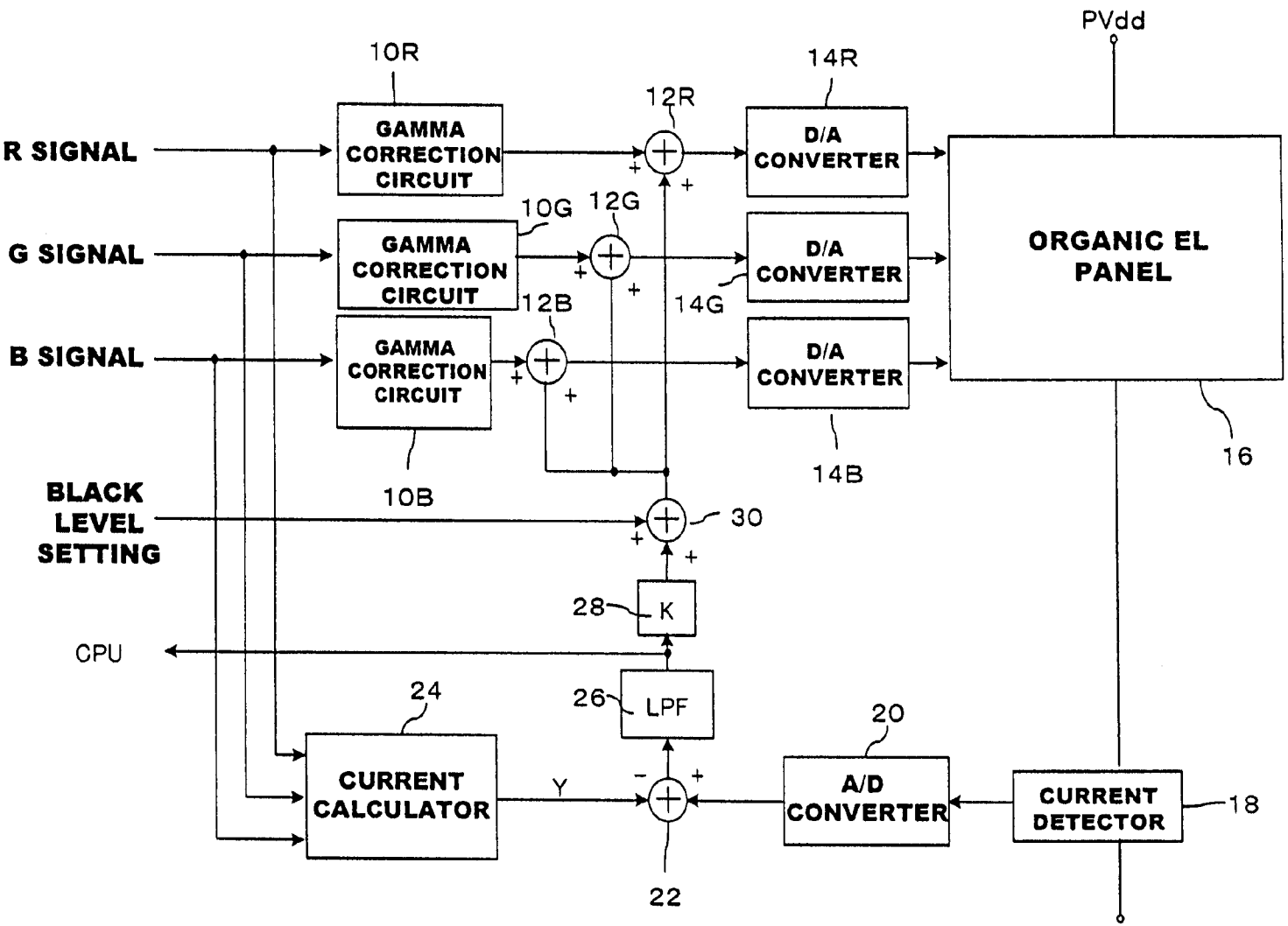
FIG. 4 is diagram showing a structure of another embodiment of the present invention.

Although a monochrome panel has been described in the above, identical control can be applied to a color panel if a current for each color can be individually detected. In actuality, however, it is often a case with a color panel that a current for each color cannot be individually measured from outside. In order to address this problem, a device of the present invention for use with a color panel comprises gamma correction circuits 10R, 10G, 10B, adders 12R, 12G, 12B, and D/A converters 14R, 14G, 14B, as shown in FIG. 4, and receives a red (R) signal, a green (G) signal, and a blue (B) signal, separately.

Specifically, an R signal, a G signal, and a B signal are input to the gamma correction circuit 10R, 10G, 10B, respectively, and given gamma correction. Outputs from the gamma correction circuits 10R, 10G, 10B are input to the adders 12R, 12G, 12B for addition of respective adjusted black level adjustment levels supplied from the adder 30. Outputs from the adders 12R, 12G; 12B are converted into analog signals in the D/A converters 14R, 14G, 14B, and supplied to the organic EL panel 16. The organic EL panel 16 has separate RGB display pixels, which are controlled for light emission according to the respective RGB luminance signals to achieve the color display.

Here, the current calculator 24 in this device applies $Y=R\times Ar+G\times Ag+B\times Ab$, wherein R, G, B are luminance data of RGB signals input, respectively, and $Ar=Ir0/r0$, $Ag=Ig0/g0$, $Ab=Ib0/b0$. Further, Ir0 indicates a total panel current flowing when displaying a red pixel with an average level r0 with adjustment so as to attain the optimum black level and the optimum maximum luminance under normal using condition;

r0 indicates an average level for red still image data for one frame, which is used in Ir0 measurement;

Ig0 indicates a total panel current flowing when displaying a green pixel with an average level g0 with adjustment so as to attain the optimum black level and the optimum maximum luminance under normal using condition;

g0 indicates an average level for green still image data for one frame, which is used in Ig0 measurement;

Ib0 indicates a total panel current flowing when displaying a blue pixel with an average level b0 with adjustment so as to attain the optimum black level and the optimum maximum luminance under normal using condition; and b0 indicates an average level for blue still image data for one frame, which is used in Ib0 measurement.

That is, a total of the levels of currents for displaying RGB colors, each being determined according to a luminance level of each of the RGB signals, is obtained and compared with a level of total panel current actually flowing in the panel, and the adder 22 outputs a difference. Therefore, a change in the actual flowing total panel current can be compensated for based on a difference between an average total panel current based on the input RGB signals and an actually flowing total panel current. This makes it possible to attain appropriate display all the time.

Alternatively, as shown in FIG. 4, a smoothed difference signal output from the LPF 26 may preferably be supplied to the CPU 40, so that the CPU 40 can read a level of an output from the LPF 26 or the adder 22 when displaying a particular image, to thereby know occurrence of a change, if any, in environmental condition.

For example, when the panel characteristic is vulnerable only to a temperature change or when a change in environmental condition other than temperature and a resultant change on the panel characteristic are known, occurrence of a change in temperature can be known with reference to this value. Similarly, in the case where a change in temperature or in other environmental condition that is caused other than presence of light incident into the panel is known, it is also possible to know presence of light incident to the panel.

When such an environmental change is known, appropriate processing can be taken. For example, to suppress heat generation by reducing luminance or ceasing display. For another example, to cool the device by using a fan or a cooling element. Moreover, to display in an appropriate manner with the presence of an incident light by increasing luminance. Alternatively, a message may be displayed, suggesting a measurement needs to be taken for heat increase or light incidence.

Figure 5B:
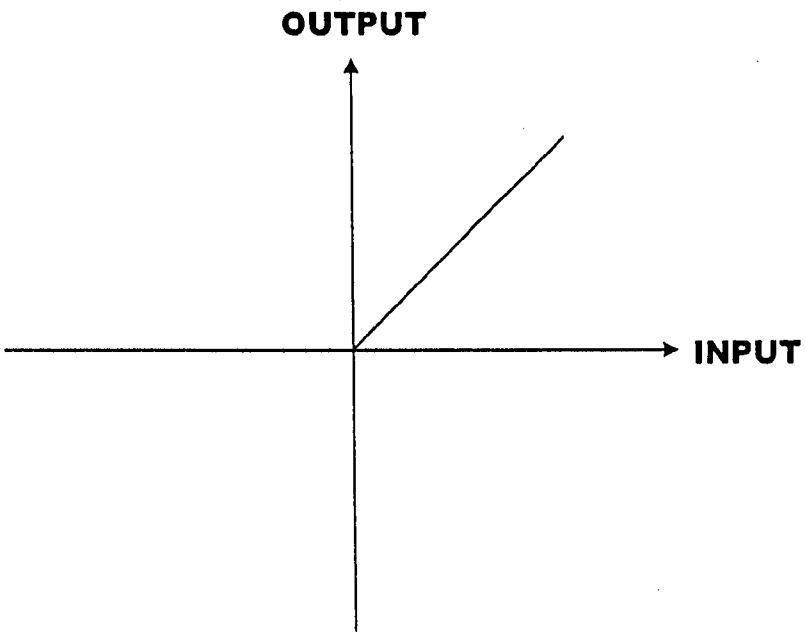
FIGS. 5A and 5B are diagrams depicting an example of a loop gain.
Figure 5A:
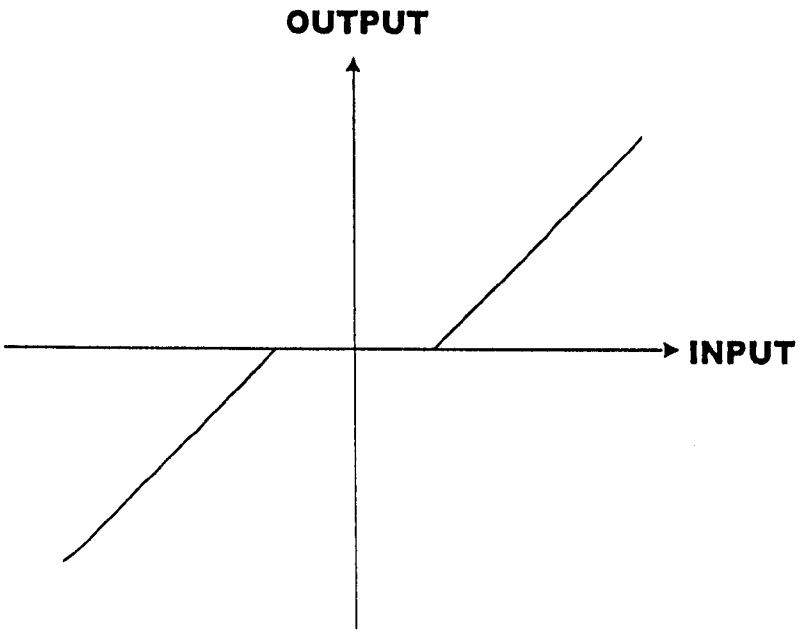

FIG. 5 shows an example of characteristics of a device which can be used in the place of an K-multiplier. That is, as shown in FIG. 5*a*, no adjustment is made, that is, K=0, while a voltage Vth varies within a predetermined range, and once a voltage Vth varies to exceed a predetermined value, a voltage Vth is adjusted using K of a predetermined level, so that an adjustment amount which is determined to be proportional to the difference is output.

Alternatively, as shown in FIG. 5*b*, an adjustment amount 0 may be output in response to an input of a negative value, whereby a shallow black phenomenon alone can be corrected. As a further alternative, an adjustment amount 0 may be output in response to an input of a positive value, whereby a flat black phenomenon alone can be corrected.

Figure 6:
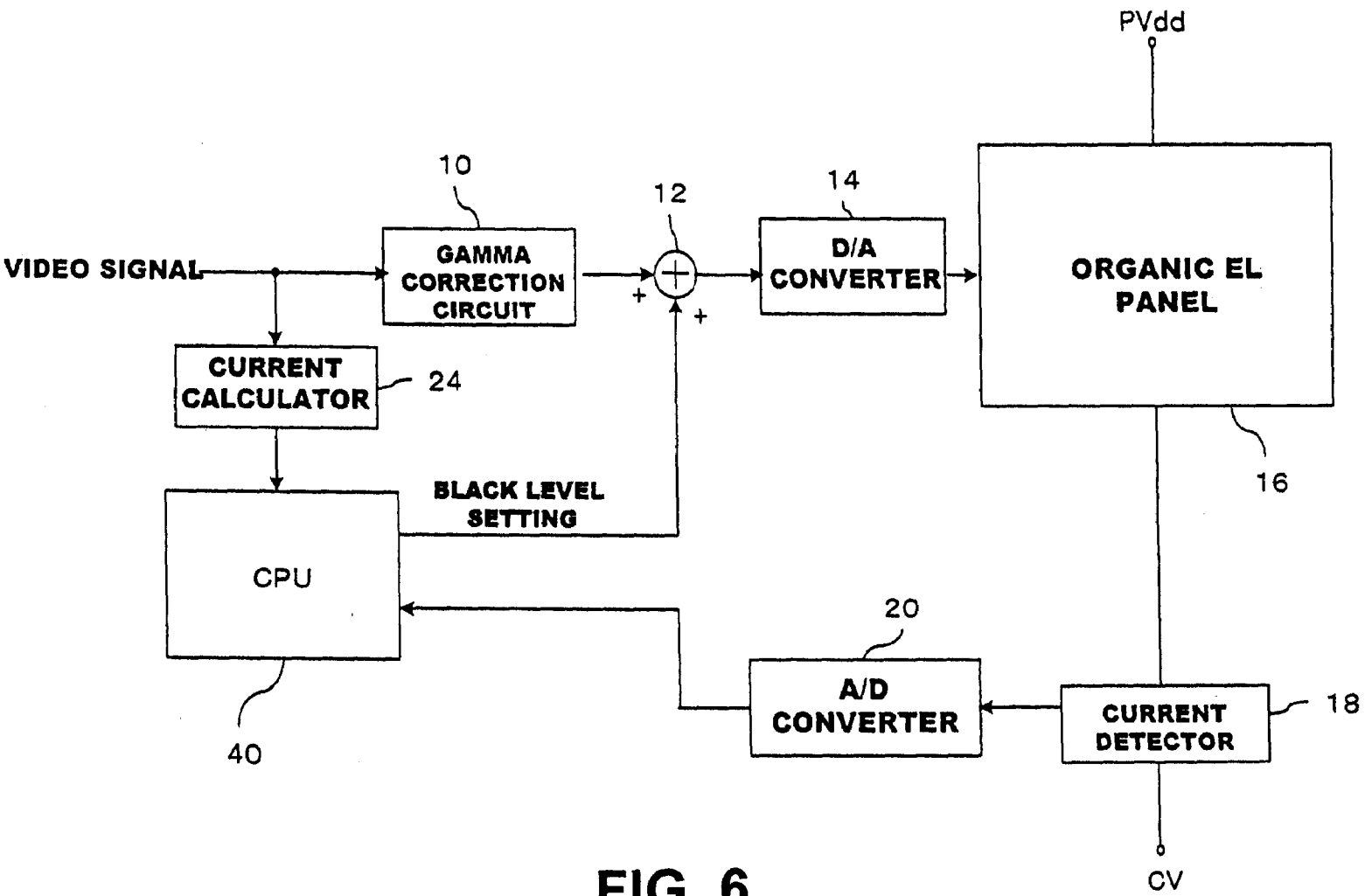
FIG. 6 is a diagram showing a structure of still another embodiment of the present invention.

FIG. 6 shows a structure of another device which is used for the present invention. With this structure, an output of the A/D converter 20 is supplied to the CPU 40, which also receives an output from the current calculator 24, so that the CPU 40 outputs an adjusted black level setting level to the adder 12.

Specifically, the CPU 40 regularly receives a total panel current value from the A/D converter 20, compares the level with a level of a current which should flow in the panel in order to attain appropriate display for a currently displayed image, to estimate variation in a voltage Vth, and adjusts a black level setting level accordingly. That is, the CPU 40 performs operations of all of the adder 22, the LPF 26, the K multiplier 28, and the adder 30, shown in FIG. 3. The CPU 40 may be able to additionally perform an operation of the current calculator 24.

Note that this structure can also accommodate full-color (RGB) display, similar to the structure of FIG. 4.

Alternatively, a dummy pixel may be provided on the panel so that the characteristic of the pixel is monitored while operating the panel, so as to apply the above-described control. Specifically, a dummy pixel is provided in an area which is covered so as not to emit light or where no displayed image is shown, and desired display data is supplied to the dummy pixel for detection of a current then flowing in the dummy pixel. A value of the detected, actually flowing current is compared with a value of an estimated current so that any change in environmental conditions in which the panel is installed can be reliably detected.

As described above, according to this embodiment, a difference between a total or average of image data for one or more frames of an image which drives a panel and a total panel current flowing through all of the pixels of the panel is fed back to be reflected in a black level voltage correction value to be input to the panel so that the optimum black input voltage can be applied to the panel even when a voltage Vth should be changed.

As described above, with an active-type organic EL panel, generally, data for each pixel is held for one frame by a capacitor connected to the gate of a pixel driving TFT. Therefore, with a structure in which a current of an amount proportional to image data is supplied to a pixel, a total amount of panel current held in a pixel section of an OLED panel as of a particular moment must be proportional to the total amount of image data having been supplied to the OLED panel by a moment prior to the particular moment by one frame. When the proportional constant is measured in advance, a total amount of current in the pixel section for each frame can be estimated based on image data.

When the total amount of the panel current is larger than the estimated level, it is assumed that a voltage Vth has been shifted in the direction a in FIG. 2. Therefore, a black level for a signal to be input to the panel is shifted in the same direction. On the contrary, when the total amount of the panel current is smaller than the estimated value, it is assumed that a voltage Vth has been shifted in the direction b in FIG. 2. Therefore, a black level for a signal is shifted in the same direction.

This arrangement can effectively prevent an image luminance change, as well as flat black or shallow black phenomenon, due to a change of a voltage Vth. This can achieve stable image display without a change in luminance and/or a black level even when the characteristic of the organic EL display element should be changed due to an environmental change or heat self-generation.

As described above, according to the present invention, a panel current estimated based on display data is compared with an actually flowing panel current, so that a black level voltage setting value is adjusted based on a result of the comparison. This makes compensation possible for a change in characteristic of an organic EL element, if such a change occurs, due to an environmental change or any other reason, and enables maintenance of appropriate display.

The invention has been described in detail with particular reference to certain preferred embodiments thereof, but it will be understood that variations and modifications can be effected within the spirit and scope of the invention.

| PARTS LIST | |
|---|---|
| 1 | driving TFT |
| 2 | TFT |
| 3 | organic EL element |
| 10 | correction circuit |
| 10R | red correction circuit |
| 10G | green correction circuit |
| 10B | blue correction circuit |
| 12 | adder |
| 12R | red adder |
| 12G | green adder |
| 12B | blue adder |
| 14 | converter |
| 14R | red converter |
| 14G | green converter |
| 14B | blue converter |

-continued

| PARTS LIST | |
|---|---|
| 16 | EL panel |
| 18 | current detector |
| 20 | A/D converter |
| 22 | adder |
| 24 | calculator |
| 26 | low pass filter |
| 28 | K multiplier |
| 30 | adder |
| 40 | CPU |

What is claimed is:

1. An organic EL display device having a display panel where a plurality of organic EL elements responsive to the display panel are arranged, comprising:

black level setting means for creating a driving command for each organic EL element, by shifting display data for each pixel relevant to an display image to be displayed on a display panel, according to a black level voltage setting level;

display data calculating means for calculating a level of estimated current which corresponds to a current which flows in the display panel, based on the display data supplied to the display panel;

panel current detecting means for detecting the panel current flowing through all pixels of the display panel;

comparing means for comparing the value of the estimated current calculated by the display data calculating means and the level of panel current for corresponding display, which is detected by the panel current detecting means, to obtain a difference; and adjusting means for adjusting the black level voltage setting value based on a result of the comparison by the comparing means.

2. The organic EL display device according to claim 1, wherein the display data calculating means calculates the value of an estimated current based on the current which would flow in the display panel upon ideal image data display, based on a total or average value of the display data; and the adjusting means adjusts the black level based on a difference obtained by the comparing means.

3. The organic EL display device according to claim 1, further comprising:

environment estimating means for estimating an environment in which the organic EL display device is installed, according to a result of the comparison by the comparing means.

* * * * *